United States Patent [19]

Kochannek

[11] Patent Number: 4,618,319

[45] Date of Patent: Oct. 21, 1986

[54] VANE-TYPE COMPRESSOR HAVING RESILIENT SLOT SEALS

[75] Inventor: Franz Kochannek, Schwabach, Fed. Rep. of Germany

[73] Assignee: Robert Bosch GmbH, Stuttgart, Fed. Rep. of Germany

[21] Appl. No.: 794,241

[22] Filed: Nov. 1, 1985

[30] Foreign Application Priority Data

Nov. 19, 1984 [DE] Fed. Rep. of Germany ..... 3442225

[51] Int. Cl.[4] ..... F04C 27/00

[52] U.S. Cl. ..... 418/136; 418/137; 418/241

[58] Field of Search ..... 418/112, 113, 136–138, 418/241

[56] References Cited

U.S. PATENT DOCUMENTS 3,346,176 10/1967 Ezop ..... 418/137
3,914,076 10/1975 Katsutoshi ..... 418/137
4,529,366 7/1985 Rembold ..... 418/137

FOREIGN PATENT DOCUMENTS 719388 4/1942 Fed. Rep. of Germany .

*Primary Examiner*—Leonard E. Smith
*Assistant Examiner*—Jane E. Obee
*Attorney, Agent, or Firm*—Michael J. Striker

[57] ABSTRACT

In a vane-type compressor, the slotted rotor includes resilient slot sealing means in the form of leaf springs. Each spring extends between consecutive slots and has curved end portions projecting into the slots and sealingly engaging opposite sides of corresponding vanes.

9 Claims, 2 Drawing Figures

VANE-TYPE COMPRESSOR HAVING RESILIENT SLOT SEALS

BACKGROUND OF THE INVENTION

The present invention relates in general to vane-type engines and in particular, to sealing means for a slotted rotor in a vane-type compressor.

From German patent DE-PS No. 719,388, for example, a vane-type compressor is known in which passages for vanes are provided with sealing pieces attached to the slotted rotor and cooperating with biasing springs. Manufacturing costs and installation of such prior art resilient seals are relatively high. Moreover, the operation of such seals is not satisfactory inasmuch as the backing springs due to their minute length cannot be reliably adjusted and act either too hard or too soft on the assigned sealing pieces. The available spring deflection is small and, therefore, a very careful and accurate installation is necessary. In operation, the prior art springs act on the sealing pieces with a relatively high pressure resulting in a high friction with the vanes. In summary, the prior art resilient sealing means, due to the above mentioned adjustment problems and increased wear due to high friction, do not provide best sealing results during the operation of vane type compressors.

SUMMARY OF THE INVENTION

It is, therefore, a general object of this invention to overcome these disadvantages.

More particularly, it is an object of the invention to provide an improved vane-type compressor having a reduced number of component parts and allowing a simpler assembly.

Another object of this invention is to improve, adjustability of resilient seals in the rotor slots.

Still another object of this invention is to reduce wear of the sealing means.

In keeping with these objects and others which will become apparent hereafter, one feature of the invention resides, in a vane-type compressor having a slotted rotor, a plurality of radial vanes arranged in the rotor and passing with a play through the slots of the rotor, and resilient sealing means for the slots, in a combination of the sealing means which comprises a plurality of leaf springs extending in the rotor between respective slots whereby end portions of adjacent springs project into the slots to sealingly engage from opposite sides the vanes.

The advantages of this invention are achieved due to substantially increased deflection paths of the sealing springs extending from one sealing point to the next one. Preferably, the leaf springs are attached to the slotted rotor midway between the respective slots and the spring arms can be produced with different rigidity and adjusted for a minimum contact pressure which is sufficient just for an effective sealing. In the preferred embodiment of this invention, no additional sealing pieces are used and the ends of the leaf springs are used directly for sealing. It is also of advantage when the leaf springs are suspended for a limited movement in a circumferential direction of the rotor so that the sealing action is improved in any operational condition of the compressor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
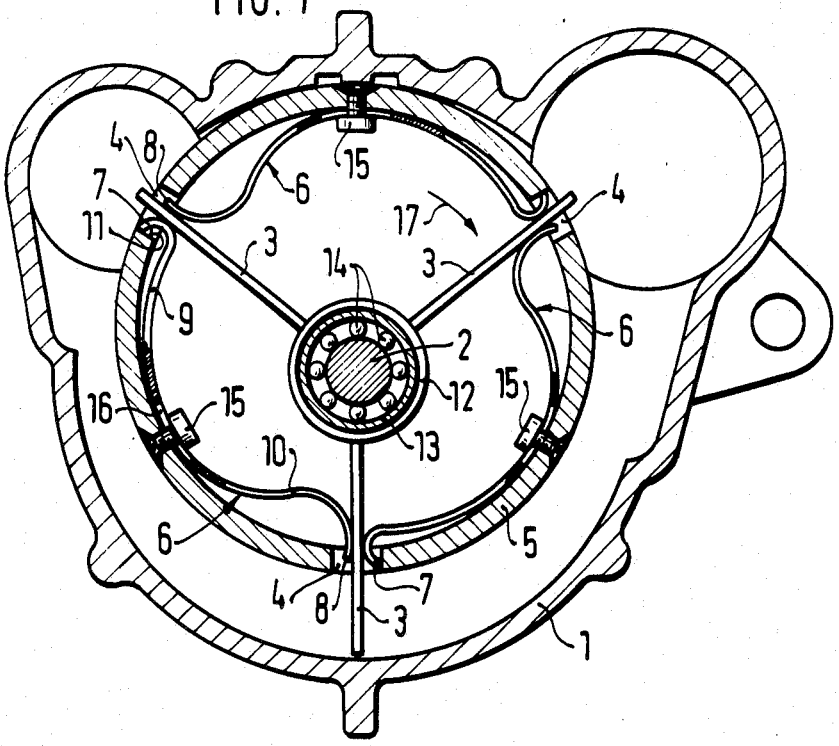
FIG. 1 is a radial cross-section of a vane-type compressor of this invention.
Figure 2:
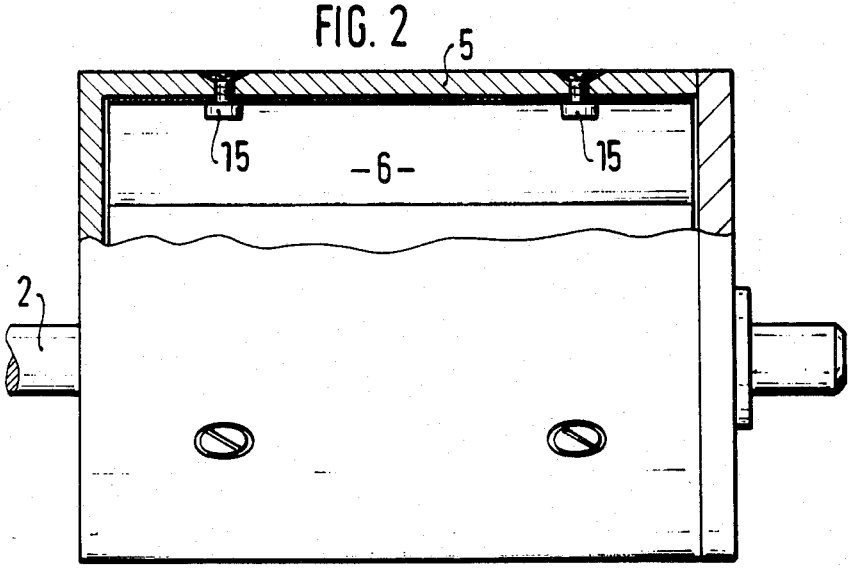
FIG. 2 is a side view, partly in section, of a slotted rotor in the compressor of FIG. 1.

In FIG. 1, a tubular rotor housing 1 encloses a tubular slotted rotor 5 which is eccentrically supported for rotation about a shaft 2. The shaft also supports for rotation a set of radial vanes 3 passing with a play through assigned slots 4 of the rotor. At the same time, curved end portions 7 and 8 of leaf springs 6 project into the slots 4 and resiliently engage from opposite sides the vanes 3. Each of the leaf springs has a hard resilient arm 9 and a softer resilient arm 10. The end portion 7 of the hard arm 9 is curved by about 180° and abuts with its end face 11 against the inner wall of the slot 4. In this manner, the hard resilient end portion 7 of each spring is rigidly held in position in the slot. Base rings 12 of the vanes 3 are supported on a bearing sleeve 13 which in turn rotates on bearing needles 14 on the shaft 2. The springs 6 are attached by two shouldered bolts 15 to the inner wall of the rotor 5 about midway between two slots 4. The stems of bolts 15 pass through narrows slots 16 in the spring so that the latter is free to move within certain limits along the circumference of the rotor. The rotor 5 rotates in the direction of arrow 17 whereby the curved end portions 7 of hard resilient arms drive the vanes 3. The softer resilient arms 10 of the springs contact with their end portions 8 the opposite sides of vanes 3 and seal off the slots 4 from the inner space of the rotor 5. Of course, it is also conceivable to provide additional sealing pieces between one or both end portions 7 and 8 and the vane surface. It is true that this modification increases the number of component parts but the installation is not rendered more difficult.

While the invention has been illustrated and described as embodied in sealing means for a vane-type compressor it is not intended to be limited to the details shown, since various modifications and structural changes may be made with departing in any way from the spirit of this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A vane-type machine comprising a rotor housing, a tubular slotted rotor supported for rotation in said housing, a set of radial vanes arranged in said rotor and passing with a play through slots of the latter, and means for resiliently sealing said vanes in said slots, said sealing means including a plurality of leaf springs extending in said rotor between consecutive slots, adjacent end portions of said springs projecting into corresponding slots to resiliently engage opposite sides of said vanes.

2. A vane-type machine as defined in claim 1 wherein said springs have two resilient arms of different rigidity.

3. A vane-type machine as defined in claim 1 wherein curved end portions of the springs sealingly engage the opposite sides of said vanes.

4. A vane-type machine as defined in claim 1 further comprising additional sealing pieces provided on said end portions of respective springs.

5. A vane-type machine as defined in claim 1 wherein one end portion of each spring is bent by about 180° to abut with its end face against an inner wall of said slot.

6. A vane-type machine as defined in claim 5 wherein the other end portion of each spring is bent to abut against a side of the vane.

7. A vane-type machine as defined in claim 1 wherein respective leaf springs are attached to said rotor midway between two consecutive slots.

8. A vane-type machine as defined in claim 7 wherein said leaf springs are shiftable in a direction normal to said slots.

9. A vane-type machine as defined in claim 8 wherein each spring has at least two mounting slots directed at right angles to said end portions, and shouldered attachment bolts passing through said mounting slots to guide said springs in said normal direction.

* * * * *